United States Patent [19]

Schwab et al.

[11] Patent Number: 4,617,099

[45] Date of Patent: Oct. 14, 1986

[54] ELECTROCHEMICAL BLEACHING OF WOOD PULPS

[75] Inventors: Gerhart Schwab, Chillicothe; Mei-Tsu Lee, Whitehall; James W. Bentley, Waverly, all of Ohio

[73] Assignee: The Mead Corporation, Dayton, Ohio

[21] Appl. No.: 812,142

[22] Filed: Dec. 23, 1985

[51] Int. Cl.[4] ..... C25F 5/00

[52] U.S. Cl. ..... 204/133

[58] Field of Search ..... 204/132, 133

[56] References Cited

U.S. PATENT DOCUMENTS 747,234 12/1903 Ruthenburg ..... 204/133

2,307,137 1/1943 Kennedy ..... 204/133

OTHER PUBLICATIONS

M. M. Nassar, O. A. Fadaly, and G. H. Sedahmed, "A New Electrochemical Technique for Bleaching Cellulose Pulp," *J. Applied Electrochemistry,* 13, 663 (1983).

M. M. Nassar, "Effect of a Chromium Salt on the Electrochemical Bleaching of Sulphite Pulp," *Surface Technology,* 21, 301 (1984).

M. M. Nassar, "Electrochemical Bleaching—A Novel Method for Bleaching Kraft and Sulphite Pulps," *J. of Pulp and Paper Science,* vol. 11, 17 (1985).

*Primary Examiner*—R. L. Andrews

*Attorney, Agent, or Firm*—Biebel, French & Nauman

[57] ABSTRACT

A process for electrochemically bleaching pulp which comprises dispersing a pulp in a solution of sodium chloride to provide a first pulp slurry; subjecting said pulp slurry to electrolysis at a pH in the range of about 0 to 2.0; filtering said pulp slurry to remove said pulp; dispersing said pulp in a second solution of sodium chloride to provide a second pulp slurry; subjecting said second pulp slurry to electrolysis at a pH greater than 8.0; and recovering said pulp.

18 Claims, 1 Drawing Figure

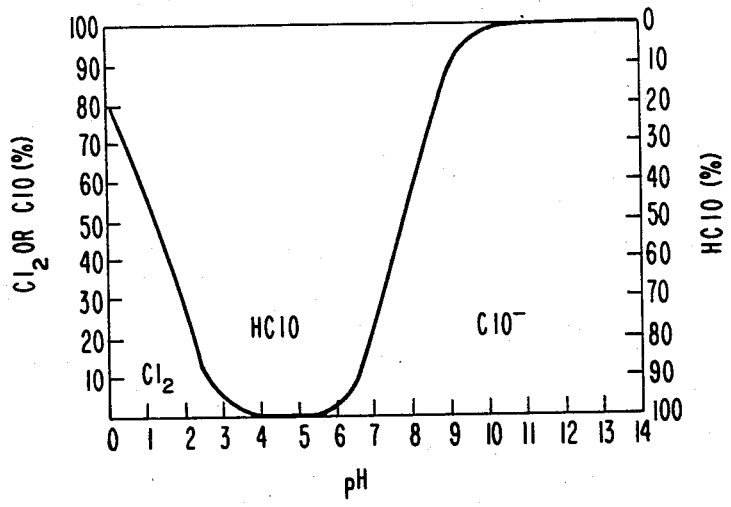
100
90
80
70
60
50
40
30
20
10
$Cl_2$ OR ClO (%)
0
10
20
30
40
50
60
70
80
90
100
HClO (%)
HClO
$ClO^-$
$Cl_2$
0 1 2 3 4 5 6 7 8 9 10 11 12 13 14
pH

ELECTROCHEMICAL BLEACHING OF WOOD PULPS

BACKGROUND OF THE INVENTION

The present invention relates to a process for bleaching pulp and, more particularly, to a process for electrochemically bleaching wood pulp.

Wood pulp, regardless of the process by which it is made, must be bleached if it is to be used in the finer varieties of light colored paper. Ordinarily, wood pulp has a portion of the lignin present in the raw fiber associated with the cellulose. Lignin contains certain colored bodies of a highly complex chemical composition which cannot be removed by any amount of washing or mechanical treatment. Thus, the purpose of all successful bleaching practices in the paper industry is to thoroughly bleach the pulp so as to produce maximum whiteness with a minimal deleterious effect on the physical and chemical properties of the pulp.

Originally, wood pulp bleaching was performed in a single operation. More recently, multistage bleaching has become the common practice. Multistage bleaching involves the addition of bleaching chemicals in stages, which are separated by intermediate washing stages with water or alkali and removal of the reaction products. In general, wood pulps are bleached with chlorine compounds, either direct chlorine plus hypochlorite, hypochlorite alone, or chlorine dioxide. One of the more common multistage bleaching processes is a three-stage process comprising: (i) chlorination, (ii) extraction, and (iii) hypochlorite bleaching.

Electrochemical bleaching of wood pulp is known in the art. In these processes, the pulp is bleached by chlorine generated through the electrolysis of a chloride salt. Sodium chloride is used since it is most abundant. Soviet Pat. No. 555,190 teaches one method in which electrolysis is performed at a 6% electrolyte concentration, an initial pH of 2.0 to 2.5, and an anode current density of 0.20 to 0.24 $A/cm^2$. Because hydrogen is evolved through the reduction of hydrogen ion during the electrolysis, and because sodium is generated forming sodium hydroxide with water, the pH of the solution gradually increases from the initial pH of 2.0–2.5 to a final pH of about 12.0–12.3 and the pulp is subjected to treatment at the intermediate pH.

Nassar, Fadaly, and Sedahmed, "A New Electrochemical Technique for Bleaching Cellulose Pulp," *J. Applied Electrochemistry*, Vol. 13, p. 663 (1983), examine the process of electrochemical bleaching. Nassar et al. identify a series of reactions according to which chlorine, hypochlorous acid, hypochlorite, and chlorate exist in the bleaching liquor. Nassar et al. also studied the electrochemical system at neutral and alkaline pH.

Electrochemical bleaching is advantageous because the cost of the bleaching process is potentially reduced, and the hazards involved in chlorine transportation and handling are eliminated. In chlorine bleaching, the pulp mills usually have to buy the required chlorine from chlorine distribution centers in liquid form, under high pressure, and at a high cost. In addition, electrochemical bleaching eliminates the pulp mills' dependence on chlorine peoducers. Thus, by installing an electrochemical bleacher, the pulp mills avoid work interruption because of strikes or shutdowns of chlorine plants.

SUMMARY OF THE INVENTION

An object of the present invention is to provide an improved process for electrochemical bleaching of wood pulps.

Another object of the present invention is to provide a process for electrochemical bleaching which provides wood pulps having improved viscosities.

An additional object of the present invention is to provide a more economical process for electrochemical bleaching of wood pulp wherein electrolysis is performed in a pulsed mode.

As with other electrochemical bleaching processes, the process of the present invention eliminates the expense and hazards involved in handling large quantities of chemicals by generating the chlorine and hypochlorite needed for the bleaching in situ from salt water. Unlike other electrochemical bleaching processes, the process of the present invention is conducted in two stages and in two distinct pH ranges. In the first stage, electrolysis is conducted at a pH in the range of about 0 to 2.0 (more preferably 0.5 to 1.0), and in the second stage, electrolysis is conducted at a pH greater than about 8.0 (preferably greater than about 9.0). This makes the process more flexible because the production conditions of the bleaching species can be adapted to operational requirements; but, more importantly, the pulp is not subjected to electrolysis at pH in the range of 3 to 8 where the hypochlorous acid concentration is high. Hypochlorous acid degrades the cellulose molecule and tends to result in pulp viscosities which are too low to be useful in papermaking.

In accordance with the present invention, the process for electrochemically bleaching pulp comprises:

dispersing a pulp in a solution of sodium chloride to provide a first pulp slurry;

subjecting said first pulp slurry to electrolysis at a pH in the range of about 0 to 2.0;

filtering said first pulp slurry to remove said pulp;

dispersing said pulp in a second solution of sodium chloride to provide a second pulp slurry;

subjecting said second pulp slurry to electrolysis at a pH greater than about 8.0; and recovering said pulp.

Other objects and advantages of the present invention will become apparent from the following description and the appended claims.

BRIEF DESCRIPTION OF THE FIGURE

The FIGURE is a graph of chlorine, hypochlorite ion and hypochlorous acid concentration as a function of pH for a chlorine solution.

DETAILED DESCRIPTION OF THE INVENTION

The electrochemical bleaching process of the present invention will find application wherever conventional chlorine, hypochlorite, or chlorine dioxide bleaching techniques are used. The process of the present invention can be used for electrochemically bleaching wood pulps such as chemical, mechanical, chemithermomechanical and chemimechanical pulps.

A bleaching reactor useful in the process of the present invention is described by Nassar, Fadaly, and Sedahmed, "A New Electrochemical Technique for Bleaching Cellulose Pulp," *J. Applied Electrochemistry*, Vol. 13, p. 663 (1983). The reactor consists of a cylindrical cell. A disc anode is placed at the cell bottom and a horizontal stainless steel screen cathode is placed a distance of about 2 cm above the anode. A particularly useful anode in the process of the present invention is a titanium anode coated with a mixture of ruthenium dioxide and titanium dioxide. Otherwise, cathode and anode materials conventionally used in electrolysis can be used.

The pulp slurry occupies the cell volume above the cathode. In this way, the possible increase in ohmic drop due to the presence of pulp suspension between the two electrodes is avoided. For very low consistency bleaching, the stirring effect of the cathodic $H_2$ and anodic $Cl_2$ bubbles serves to keep the pulp suspended in the solution and prevents its sedimentation on the cell electrodes. At higher consistencies (e.g., 3 to 10%) the pulp slurry can be stirred to keep it in suspension and assure adequate mixing of the bleaching chemicals and the pulp. To assure that no serious cellulose degradation occurs, temperature inside the cell can be thermostatically controlled.

The electrical circuit consists of a DC power supply with a voltage regulator connected in series with a multi-range ammeter and the cell. A voltmeter is connected in parallel with the cell to measure the cell voltage.

The process of the present invention can conveniently be broken down into three stages: (i) chlorine bleaching (ii) filtration followed by hot water wash, and (iii) hypochlorite bleaching.

The pulp slurry is usually prepared outside the cell by mixing salt water and pulp under continuous stirring to break up pulp flocks and disperse them in the electrolyte. Typically, the consistency of the first stage pulp slurry is about 3.0 to 10%, with a preferred pulp consistency of about 5 to 7%.

For first stage bleaching, the pulp slurry must contain, at a minimum, sufficient NaCl to satisfy the chlorination demand in the first stage of the electrochemical bleaching process. The pulp slurry generally has a NaCl concentration of about 0.5 to 2.5%, with a preferred NaCl concentration being in the range of 1.5 to 2.5%. As Nassar et al. indicate, by increasing the salt concentration the rate of bleaching can be increased.

The current density at the anode is usually approximately 0.04 to 0.16 $A/cm^2$, with a preferred current density being in the range of 0.06 to 0.1 $A/cm^2$. The salt concentration and the current density are adjusted to provide the most economical set of operating conditions. Thus, the required chlorine concentration can be reached using a combination of low voltages and high salt concentrations or higher voltages and lower salt concentrations. The combination of conditions is selected which is the most cost effective. The relationship between the area of the anode and the slurry volume is also important from the standpoint of being able to efficiently generate the quantities of bleaching agents that are required for the volume of pulp being bleached. This ratio should be about 0.05 $cm^{-1}$.

Electrochemical bleaching is typically carried out at room temperature, but higher temperatures can be used. The bleaching rate increases as the temperature increases up to a point where the increased temperature drives the bleaching agents, which are gaseous, from the slurry.

During the chlorine bleaching stage, the pulp slurry is subjected to electrolysis at a pH in the range of about 0 to 2.0. At this pH level, the equilibrium of the following solution reaction favors the production of chlorine gas:

$$3Cl_2+3H_2O\ 3HClO+3Cl^-+3H^+$$

The FIGURE is a graph showing the relationship between pH and chlorine, hypochlorous acid (HCLO) and hypochlorite ion ($ClO^-$) concentration. The pH is selected such that the desired combination of brightness and viscosity is obtained in the pulp. As shown in the FIGURE, as the pH increase above about 0.5 to 1.0, the hypochlorous acid concentration increases rapidly. Thus, to retain high viscosity in the pulp, the pH should not exceed about 1.0, but pH up to about 2.0 are useful if a low pulp viscosity is acceptable. The relationship shown in the FIGURE will vary slightly depending on the chlorine concentration and the temperature.

The duration of the chlorine bleaching stage is determined by the desired brightness level and viscosity following the filtration stage. Generally bleaching is continued until further bleaching will not substantially improve brightness. The duration of chlorine bleaching stage will vary depending upon the nature of the pulp, temperature, current density, pulp consistency, and salt concentration. Typically, the chlorine bleaching stage is run for about 10 to 30 minutes. In setting the chlorine bleaching stage reaction temperature, an increased temperature which would result in a decrease in reaction time must be balanced against the tendency for the elevated temperature to drive the bleaching chemical, which is predominantly $Cl_2$, from the slurry. Typically, the chlorine bleaching stage is conducted at ambient temperature, but reaction temperatures ranging from about 20° to 45° C. can be used.

In accordance with a more particular embodiment of the invention, the electrolysis of the chlorine bleaching stage is run in a pulsed mode. Periodically, the current is turned on to produce chemicals, and then turned off while the chemicals are consumed by the pulp. Operation in a pulsed mode avoids chlorine accumulation and lowers electrical costs while achieving the same favorable results. Typically, the current is turned on for about 5 to 15 minutes, and then turned off for about 5 to 15 minutes. This sequence is repeated until the desired brightness level is achieved.

In the chlorine bleaching stage, the pH of the pulp slurry is not permitted to rise above about 2.0. Known processes, which allow drifting through the pH range of 3 to 8 where hypochlorous acid is formed, degrade the cellulose molecules to a large extent and result in pulp viscosities which are too low to be useful in papermaking. The process of the present invention employs two well-defined and carefully-controlled pH ranges to avoid such cellulose degradation.

During the filtration stage, the pulp slurry is filtered to remove the soluble organics which were generated in the chlorine bleaching stage. In a preferred embodiment, after subjecting the pulp slurry to filtering, the process comprises the additional step of washing the removed pulp with hot water. The washing removes soluble lignin and thus reduces the amount of bleaching required in the subsequent hypochlorite bleaching stage. In another alternative embodiment of the invention, the pulp can be extracted with an alkaline solution at this stage of the process. Typically, the pulp is treated with a solution of sodium hydroxide having a concentration of 0.5N. The extraction is carried out at temperatures of about 50° C.

In preparation for the hypochlorite stage, the pulp is dispersed in salt water to provide a second pulp slurry. The pulp slurry must contain sufficient NaCl to supply the chlorine requirements of the hypochlorite bleaching stage. Typically, the hypochlorite stage reaction temperature is about 20° to 70° C., and the current density is about 0.04 to 0.16 A/cm$^2$. The same considerations which govern salt concentration, pulp consistency and current density in the first stage are applicable to the second stage.

During the hypochlorite stage, the pulp slurry is subjected to electrolysis at a pH greater than 8.0 and preferably in the range of about 9.5 to 12.0. Higher pH can be used but with additional expense (cost of alkali) and without substantial benefit. At this pH level, the equilibrium of the following solution reaction favors the generation of hypochlorite:

$$3Cl_2+3H_2O \rightleftharpoons 3HClO+3Cl^-+3H^+$$

$$HClO+OH^- \rightleftharpoons ClO^-+H_2O$$

$$Cl_2+2OH^- \rightleftharpoons ClO^-+H_2O+Cl^-$$

The FIGURE shows the relationship between pH and hypochlorite ion concentration. Lower pH than 8.0 can be used but the hypochlorous acid concentration increases rapidly and there will be a loss in pulp viscosity.

The hypochlorite stage operates for a time sufficient to yield the desired final brightness and viscosity. Again, this will vary with the type of pulp and bleaching conditions, such as pulp consistency, NaCl concentration, temperature, and current density.

Comparable to the chlorination stage, the electrolysis of the hypochlorite stage can be run in a pulsed mode. Periodically, the current is turned on to produce chemicals, and then turned off while the chemicals are being consumed. Typically, the current is turned on for about 5 to 15 minutes, and then turned off for about 5 to 15 minutes. This will, however, vary with the current density and the relationship between the size of the anode and the volume of the pulp slurry.

By employing two well-defined and carefully-controlled pH ranges during bleaching, the process of the present invention results in a marked improvement in final brightnesses and viscosity over prior electrochemical bleaching processes.

The present invention is more fully illustrated by the following non-limiting example.

EXAMPLE

A Mead Hardwood Kraft pulp was bleached in a cylindrical plexiglas cell having a diameter of 11 cm and a height of 24 cm. A titanium disc anode, coated with a mixture of ruthenium dioxide and titanium dioxide and having a diameter of 11 cm, was placed at the cell bottom. A horizontal stainless steel screen cathode was placed at a distance of 2 cm above the anode. To assure that no serious cellulose degradation occurred, the temperature inside the cell was monitored closely.

The pulp slurry occupied the cell volume above the cathode to avoid a possible increase in ohmic drop due to the presence of pulp suspension between the two electrodes. The stirring effect of the cathodic $H_2$ and anodic $Cl_2$ bubbles served to keep the pulp suspended in the solution and prevented its sedimentation on the cell electrodes at low pulp consistency.

The electrical circuit used consisted of a power supply with a voltage regulator connected in series with a multi-range ammeter and the cell. A voltmeter was connected in parallel with the cell to measure the cell voltage.

A series of studies were performed to obtain the relationship betwee final brightness and time in the chlorine and hypochlorite stage of chlorine bleaching-filtration-hypochlorite bleaching. The chlorine bleaching stage was performed using a 2-liter pulp slurry which contained 0.5% NaCl and 3% pulp at pH 1.0. The mixture was electrolyzed to produce chlorine in situ; in turn, chlorine was consumed by the pulp. The electrolysis was done in a pulsed mode. The current density at the anode was 0.06 A./cm$^2$. The current was turned on 5 minutes to produce $Cl^2$. The current was then turned off for 5 minutes to allow excess $Cl_2$ to be consumed by the pulp. This sequence was repeated three times. Thus, the total chlorine bleaching stage time was 30 minutes.

The pulp slurry was then filtered and washed with hot water. The brightness of the pulp in this stage was 47, and the viscosity was 25.73 cps. The hypochlorite bleaching stage was performed similarly to the chlorine bleaching stage except that the pH of the slurry was adjusted to 11.0 with sodium hydroxide solution. Electrolysis was conducted in a pulsed mode except the current was turned on for 10 minutes and then turned off for 10 minutes. The table below shows the relationship between brightness and bleaching time. For the chlorine stage, chlorine bleaching (pH=1.0) time was varied and the pulp was subjected to a fixed hypochlorite (pH=11.0) stage of 180 min. For the study of the hypochlorite stage, chlorine bleaching time was fixed at 30 min. and hypochlorite bleaching time was varied. The results of brightness and time relationship of this stage are listed below.

| Chlorine Stage Time (min.) | Final Pulp Brightness |
|---|---|
| 30 | 82.96 |
| 20 | 83.9 |
| 15 | 83.45 |
| 10 | 81.93 |
| 5 | 78.94 |

| Hypochlorite Stage Time (min.) | Final Pulp Brightness |
|---|---|
| 0 | 46.79 |
| 40 | 73.69 |
| 60 | 77.20 |
| 80 | 77.95 |
| 100 | 79.16 |
| 120 | 81.61 |
| 140 | 82.68 |
| 160 | 83.50 |
| 180 | 84.42 |

These results indicated that the initial bleaching was very rapid because the brightness increased from 46.79 to 77.20 in 60 minutes. After this, the brightness only increased approximately 1% for every 20 minutes of bleaching. For economically better results a pulp concentration of 6% was run under similar conditions, although current density was 0.1 A/cm$^2$, NaCl cone in the second stage was 1.5% and total bleaching time was 2 hrs., achieving the same final brightness.

Having described the invention in detail and by reference to preferred embodiments thereof, it will be apparent that modifications and variations are possible without departing from the scope of the invention defined in the appended claims.

What is claimed is:

1. A process for electrochemically bleaching pulp which comprises:

dispersing a pulp in a solution of sodium chloride to provide a first pulp slurry;

subjecting said pulp slurry to electrolysis at a pH in the range of about 0 to 2.0;

filtering said pulp slurry to remove said pulp;

dispersing said pulp in a second solution of sodium chloride to provide a second pulp slurry;

subjecting said second pulp slurry to electrolysis at a pH greater than 8.0; and recovering said pulp.

2. The process of claim 1 wherein said first pulp slurry has a pH of about 0.5 to 1.0 and said second pulp slurry has a pH of about 9.5 to 12.0.

3. The process of claim 2 wherein after subjecting said pulp slurry to filtering, said process comprises the additional step of washing said filtered pulp repeatedly with boiling water.

4. The process of claim 3 wherein after subjecting said first pulp slurry to electrolysis, said process comprises the additional step of extracting said first pulp slurry with an alkaline solution.

5. The process of claim 1 wherein said first pulp slurry is subjected to electrolysis in a pulsed mode.

6. The process of claim 1 wherein said second pulp slurry is subjected to electrolysis in a pulsed mode.

7. The process of claim 1 wherein a titanium anode coated with a mixture of ruthenium dioxide and titanium dioxide is used to subject said pulp to electrolysis.

8. The process of claim 1 wherein said first pulp slurry has a NaCl concentration of approximately 0.5% to 2.5%.

9. The process of claim 8 wherein said first pulp slurry has a consistency of approximately 3% to 10%.

10. The process of claim 9 wherein said first pulp slurry is subjected to electrolysis at a current density at said anode of approximately 0.04 to 0.16 $A/cm^2$.

11. The process of claim 10 wherein said first pulp slurry is subjected to electrolysis at a temperature of approximately 20° to 45° C.

12. The process of claim 11 wherein said second pulp slurry has a NaCl concentration of approximately 0.5 to 2.5.

13. The process of claim 12 wherein said second pulp slurry has a consistency of about 3% to 10%.

14. The process of claim 13 wherein said second pulp slurry is subjected to electrolysis at a temperature of approximately 20° to 70° C.

15. The process of claim 1 wherein said pulp is a softwood pulp.

16. The process of claim 1 wherein said pulp is a hardwood pulp.

17. The process of claim 13 wherein said first pulp slurry has a consistency of about 5% to 7%.

18. The process of claim 17 wherein said second pulp slurry has a consistency of about 5% to 7%.

* * * * *